US005409046A

United States Patent [19]

Swenson et al.

[11] Patent Number: 5,409,046

[45] Date of Patent: * Apr. 25, 1995

[54] SYSTEM FOR FAST-FILLING COMPRESSED NATURAL GAS POWERED VEHICLES

[76] Inventors: Paul F. Swenson, 20431 Almar, Shaker Heights, Ohio 44122; George H. Eversole, 800 W. Shannon Dr., Bridgeport, W. Va. 26330

[ * ] Notice: The portion of the term of this patent subsequent to Apr. 28, 2009 has been disclaimed.

[21] Appl. No.: 856,554

[22] Filed: Mar. 24, 1992

Related U.S. Application Data

[63] Continuation-in-part of Ser. No. 649,238, Jan. 29, 1991, Pat. No. 5,107,906, which is a continuation of Ser. No. 416,145, Oct. 2, 1989, abandoned.

[51] Int. Cl.[6] ..... F17C 7/04

[52] U.S. Cl. ..... 141/11; 141/4; 141/82; 141/197; 141/248; 141/18; 141/2; 141/83; 62/50.2

[58] Field of Search ..... 141/1-5, 141/7, 11, 18, 21, 69, 70, 82, 83, 94, 95, 98, 100, 102, 104, 105, 107, 192, 197, 234, 236, 248; 62/50.1-50.5; 137/255, 263; 123/525, 527; 48/190-192

[56] References Cited

U.S. PATENT DOCUMENTS

| | | | |
|---|---|---|---|
| 1,419,880 | 6/1922 | Mauclere | 141/18 |
| 2,028,119 | 1/1936 | Boshkoff | 62/50.2 |
| 2,252,830 | 8/1941 | Bliss et al. | 62/50.2 |
| 2,443,724 | 6/1948 | Cibulka | 62/50.2 X |
| 2,732,103 | 1/1956 | Wright et al. | 222/330 |
| 2,964,917 | 12/1960 | Webster | 62/50.3 |
| 3,720,057 | 3/1973 | Arenson | 62/50.2 X |
| 3,898,853 | 8/1975 | Iung | 62/50.1 |
| 3,962,882 | 6/1976 | Gee et al. | 62/50.1 |
| 3,986,340 | 10/1976 | Bivins, Jr. | 62/50.2 |
| 4,321,796 | 3/1982 | Kohno | 62/52 |
| 4,646,940 | 3/1987 | Kramer et al. | 141/197 X |
| 4,680,937 | 7/1987 | Young | 62/54 |
| 4,738,115 | 4/1988 | Goode | 62/53 |
| 4,749,384 | 6/1988 | Nowobilski et al. | 123/527 |
| 4,751,822 | 6/1988 | Viard | 62/50.2 |
| 4,898,217 | 2/1990 | Corbo et al. | 141/83 |
| 4,987,932 | 1/1991 | Pierson | 141/1 |
| 5,127,230 | 7/1992 | Neeser et al. | 62/7 |
| 5,147,005 | 9/1992 | Haeggstrom | 130/69.5 |
| 5,163,409 | 11/1992 | Gustafson et al. | 123/525 |
| 5,228,295 | 7/1993 | Gustafson | 62/7 |

FOREIGN PATENT DOCUMENTS

| | | | |
|---|---|---|---|
| 5142198 | 11/1980 | Japan | 62/50.2 |
| 1095012 | 5/1984 | U.S.S.R. | 141/105 |

*Primary Examiner*—J. Casimer Jacyna

[57] ABSTRACT

A method of refueling a road transportation vehicle or the like comprising receiving and storing liquid natural gas in a relatively large supply tank at relatively low temperature and moderate pressure, dispensing the liquid natural gas from the supply tank generally exclusively on demand when a vehicle is present for refueling, delivering the dispensed gas to a high-pressure fuel tank on the vehicle while simultaneously converting it to compressed natural gas at relatively high pressure and moderate temperature through the addition of energy to the gas primarily in thermal form. In one embodiment the pressure of the natural gas is elevated by a mechanical pump while in another embodiment the pressure of the natural gas is raised primarily by the addition of heat.

9 Claims, 5 Drawing Sheets

200
LNG STORAGE
201
202
204a
206
203a
208
212b
211a
267
268
CONTROLLER
203b
203c
203d
203e
207
240
248
245
241
263
262
247
246a
204e
266
246b
237
238
244
242
243
264
213
239
252
265
249
31
34
251
259
PRIORITY PANEL
SEQUENCING PANEL
14
33
16
32
254
253
255
260
43
49
40
250
52
48
47
256
257
258
42
270
51
214
LOW PRESS.
MED. PRESS.
HIGH PRESS.

SYSTEM FOR FAST-FILLING COMPRESSED NATURAL GAS POWERED VEHICLES

BACKGROUND OF THE INVENTION

This application is a continuation-in-part of application Ser. No. 649,238, filed Jan. 29, 1991, now U.S. Pat. No. 5,107,906, which application is a continuation of application Ser. U.S. Pat. No. 416,145, now abandoned filed Oct. 2, 1989.

The invention relates to alternate fuels for the transportation industry and, in particular, relates to a system for utilizing natural gas as a fuel for road vehicles.

Natural gas offers an alternative fuel for road vehicles and is currently used as such on a limited scale. In most instances, in current use, natural gas is carried aboard the vehicle in a high-pressure tank with a working pressure of, for example, 3,000 or 3,600 psi. Conventionally, the vehicle fuel tank is filled from a battery of tanks storing gas at a pressure somewhat higher than the vehicle tank working pressure or is filled over a relatively long period, overnight for example, from a small compressor.

These conventional tank filling systems are not well-suited for use with those large transportation vehicles which must be refueled in a relatively short time, for example, of several minutes to satisfy established operational constraints related to servicing, storage and/or usage procedures. The capital cost of a bank of storage tanks or of a compressor that can deliver flow rates to satisfy a fast-fill requirement can be prohibitive. Further, a refueling depot for mass transit busses, highway trucks, or other high fuel volume applications may exist at a location not served by a natural gas pipeline or by a pipeline of adequate capacity. Liquid natural gas (LNG) offers relatively high energy per unit volume and could be readily employed in a relatively inexpensive refueling facility for fast-filling of large transportation vehicles. However, in some locations LNG cannot be carried on-board in a vehicle fuel tank because of safety regulations.

SUMMARY OF THE INVENTION

The invention provides a system for refueling vehicles with compressed natural gas at high mass-flow rates that utilizes a store of liquid natural gas to avoid the need for expensive compressors or a large bank of compressed natural gas storage tanks. In accordance with the invention, liquid natural gas is converted to compressed natural gas on a demand basis, the conversion being accomplished at the same time the vehicle fuel tank is being filled.

In one disclosed embodiment of the invention, natural gas is stored in a tank in the liquid state at cryogenic temperatures and relatively low pressure. When a vehicle is present to be refueled, liquid natural gas is dispensed from the tank by a pump which increases its pressure above that required in the vehicle fuel tank. The liquid natural gas is caused to pass through a heat exchanger where thermal energy is added to the gas to cause it to change into its vapor state and to raise its temperature into the ambient range. Advantageously, heat for changing the gas from its liquid to its vapor state, besides that absorbed from the environment in an air heated heat exchanger can be derived from combustion of small quantities of the natural gas being processed.

The invention avoids the need for expensive high volumetric capacity compressors or banks of high-pressure storage tanks which would otherwise be required for providing high fill rates for large transportation vehicles.

In a variant of the invention, liquid natural gas is dispensed on demand from a cryogenic low-pressure storage tank cyclically into alternate conversion tanks where heat transforms the gas from its liquid state to a high-pressure gaseous state. Typically, the conversion tanks operate only when there is a demand for a vehicle fuel tank to be filled. The conversion tanks can utilize heat from the environment and/or heat of combustion of a small percentage of the stored gas. In this arrangement, a low-pressure differential pump is used to dispense liquid natural gas from the storage tank to the conversion tanks.

In accordance with an important aspect of the invention, the conversion of LNG to a high pressure gas is accomplished in a plurality of vessels that each operate through vaporization and pressurization cycles that are out of phase with those of the other vessels. Like other systems disclosed herein, this system and method provide, on a demand basis, a substantially constant flow of high pressure gas converted from a source of LNG in an associated low pressure storage tank. The disclosed system and method utilizing, primarily, thermal energy to accomplish the conversion from low pressure LNG to high pressure gas avoids an expensive high pressure-lift cryogenic pump or even a more costly primary compressor that would raise the pressure of all gas, transformed from the liquid phase, from the pressure of the LNG storage tank.

DESCRIPTION OF THE PREFERRED EMBODIMENTS

Figure 1:
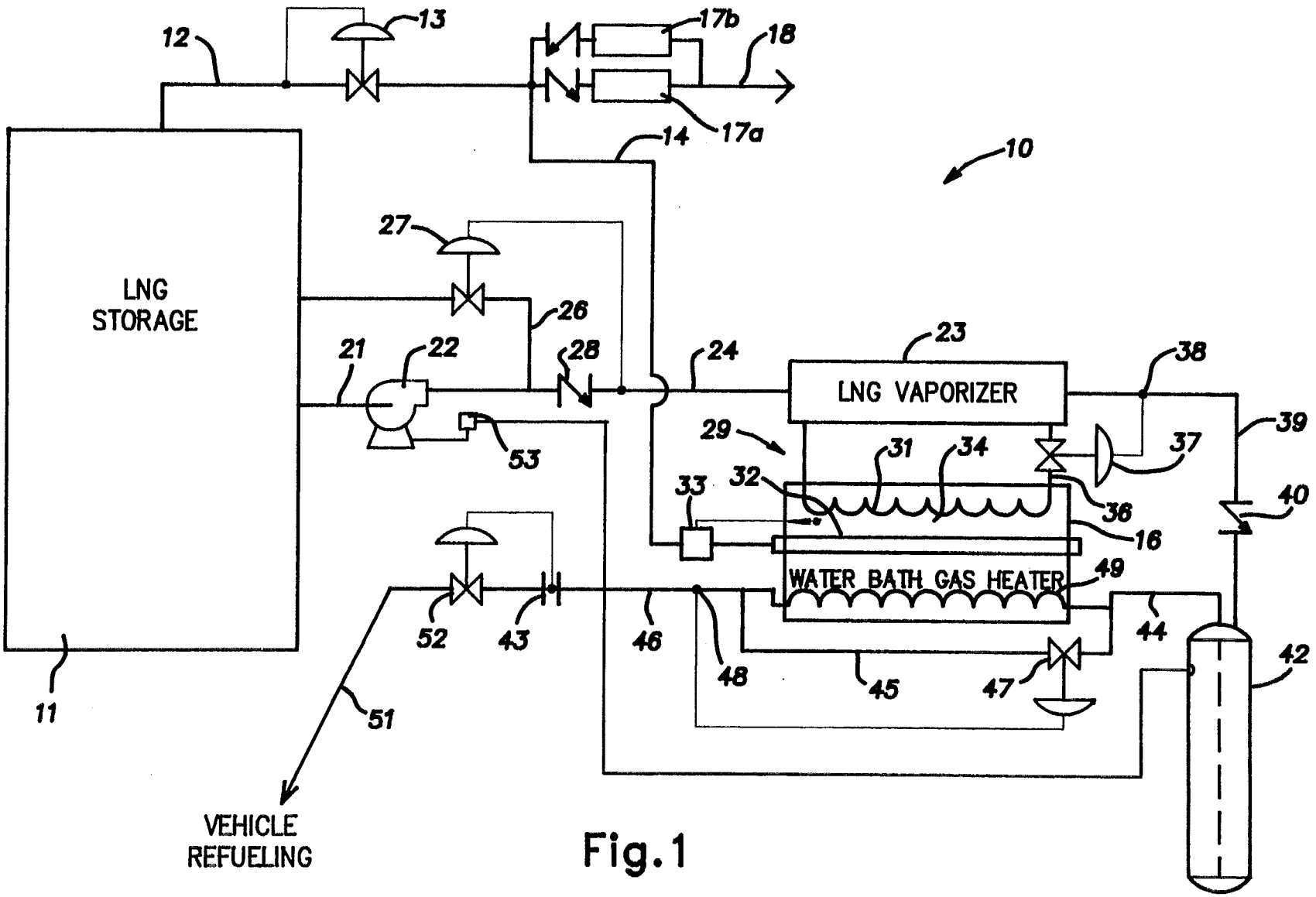
FIG. 1 is a schematic diagram illustrating a first embodiment of the invention.

Referring now to the drawings and in particular to FIG. 1, there is represented a site 10 at which transportation vehicles such as mass-transit busses, school busses, highway trucks or delivery trucks can be refueled with natural gas. A main storage tank 11 of the system or site 10 holds liquid natural gas at cryogenic temperatures, i.e. between approximately −240° F. to −160° F. and relatively low pressure, i.e. from about 30 to 100 psi above atmospheric pressure. Typically, for a bus depot, the tank 11 can have a capacity of 20,000 gallons. The tank 11 can be of known construction and is insulated from the surrounding environment in a manner that allows it to maintain the pressure of its contents within the 30 to 100 psi working range for at least several days. The tank 11 receives liquid natural gas, for example, from a tanker truck or railroad tank car.

The tank 11 is vented by a line 12 that includes a safety pressure relief valve or regulator 13. Natural gas which has boiled off the liquid in the tank 11 is released by the pressure regulating valve 13 and is conducted by a line 14 to a burner of a water bath heater 16 where it can be combusted as discussed below. Excess vaporous fuel boil-off from the vent line 12 can be directed through a meter 17*a* into a utility distribution line 18, if desired. Another meter 17*b* can be provided to supply utility gas to make up any shortfall of boil off required by the heater 16.

A line 21 conducts liquid natural gas from the store in the tank 11 to the inlet of a high-pressure pump 22. The mechanical pump which may be of the positive displacement type raises the pressure of the liquid natural gas to a pressure of 3,100 or 3,700 psi, for example, so that it is somewhat above the maximum operating pressure at which a vehicle fuel tank is operated, for example 3,000 or 3,600 psi. The pump 22 delivers high-pressure liquid natural gas to a heat exchanger 23 through a line 24. A branch line 26 connected to the pump discharge line 24 allows excess pressure to be relieved back to the tank 11 under the control of a pressure regulator 27. A check valve 28 is provided in the line 24 between the branch line 27 and heat exchanger 23. The lines 21, 24 and 26 and components 22, 27 and 28 carrying liquid natural gas are thermally insulated from the environment. The energy required by the pump 22 to raise the pressure of the liquid natural gas to these pressures is a small percentage of what would be required if the natural gas was in its vapor state and was compressed to raise its pressure by the same differential.

The schematically illustrated heat exchanger 23 is of the shell and tube type, of generally conventional construction, arranged to carry the natural gas in the tubes portion. A propane circuit indicated generally at 29 has propane circulating through the shell section of the heat exchanger 23. The propane circuit 29 includes a propane heating coil 31 which is immersed in the tank of the water bath heater 16. An immersion heater or burner schematically illustrated at 32 combusts the vaporous natural gas boil-off coming from the tank 11 through the line 14 to heat the water in the heater 16. The burner 32 consists of a flame holder surface at one end of a tube containing the products of combustion submerged in water contained in the tank of the heater 16. A thermostatic controller 33 controls the amount of gas being burned by the burner 32 to maintain the water bath 34 of the heater 16 at a desired temperature of, for example, 68° F. The propane circuit 29, in the illustrated example, operates by natural convection with warm propane gas being produced in the heating coil 31 and rising to the shell of the heat exchanger 23 where it exchanges heat with the liquid natural gas in the tubes being supplied by the pump 22. The propane condenses in the heat exchanger shell and returns to the water bath coil 31 through a line 36 and an associated temperature controller 37. The controller 37 has a thermostatic element 38 sensing the temperature of natural gas leaving the heat exchanger 23 and regulates the amount of flow through the propane heating circuit 29 accordingly. It is the objective of the controller 38 to maintain LNG at a supercritical state above the saturated vapor dome within the heat exchanger 23, so that most of the superheating of the methane gas occurs in circuit 49. As an alternative to propane, other low temperature heat transfer fluids can be employed, such as argon.

Natural gas in a cryogenic liquid state is delivered at high pressure to the heat exchanger 23. This natural gas is changed to a vapor state by absorption of heat from the circulating propane in the heat exchanger 23. Natural gas vapor from the heat exchanger is conducted from the exchanger 23 through a line 39 and a check valve 40 to a surge tank 42. The natural gas at this point will be at a supercritical state above the saturated vapor dome for pure methane, e.g. −60° F. to −100° F. The surge tank 42 serves to stabilize the pressure of the natural gas to achieve improved final delivery control to a vehicle. From the tank 42 natural gas is delivered to a volumetric meter 43 through a parallel pair of lines 44–46. A temperature control valve 47 in the line 45, having a thermostatic control element 48 in the line 46 before the meter, assures that the temperature of, for example, 67° F. of gas combined from both circuits is delivered to the meter 43 is at a proper desired temperature for metering. This is accomplished by the valve 47 restricting the volume of flow through the line 45 in proportion to flow through a heating coil 49 in the water bath heater 16 that is in a parallel flow circuit with the line 45. Gas is delivered to a vehicle through a line 51. A flow control valve 52 in the line 51 limits the rate of flow delivered through the line 51.

The pump 22 is on when a vehicle is present for refueling. The pump is off otherwise. If desired, a controller 53 can be provided to sense pressure in the tank 42 and modulate operation of the pump 22 for example by speed. When fuel vapor is delivered through the line 51 and pressure in the tank 42 tends to be lowered, the pump 22 is operated accordingly to dispense liquid natural gas from the storage tank 11 into the heat exchanger 23 to make up for any volume of natural gas vapor being dispensed on demand. In general, the surge tank 42 can have a volume that is relatively small and, ordinarily, is a fraction, for example 1/5, the volume of a typical fuel tank capacity on a large vehicle being refueled at the site 10.

Where the boil-off of the gas in the storage tank 11 is not sufficient, additional heat energy can be provided by diverting a small quantity of the natural gas vapor produced by the heat exchanger 16, through appropriate pressure-reducing control circuitry (not shown). It is preferable in most cases to provide any additional fuel from line 18, to avoid the complication of pressure reduction. In general, approximately 1 to 1-½% of the gas stored in the tank 11 is necessary for converting it from its cryogenic liquid state to a vapor state at high pressure and moderate temperature.

Figure 2:
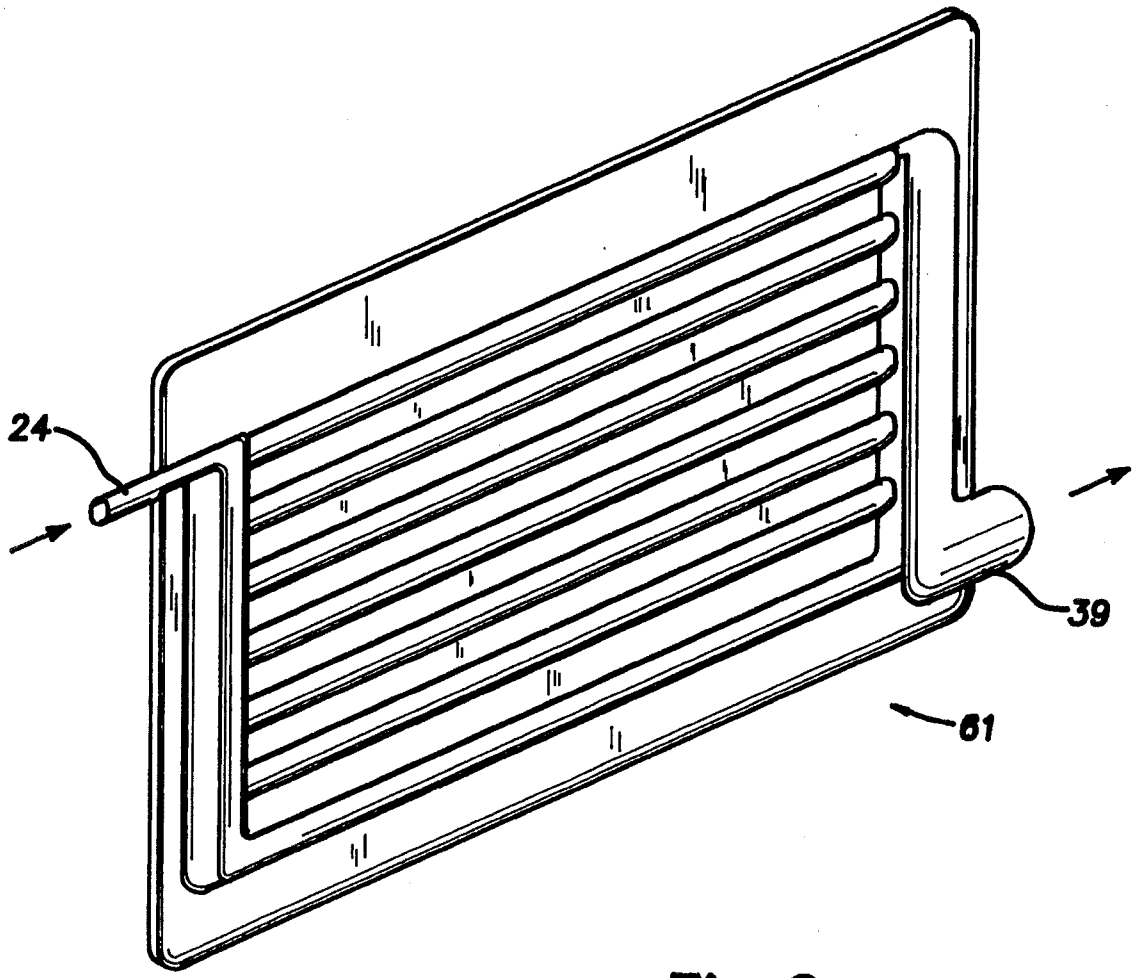
FIG. 2 is an illustration of an alternative heating system to that shown in FIG. 1.

As a variant to the system disclosed in FIG. 1, FIG. 2 illustrates a substitute heating means in the form of a plate-type heat exchanger 61. The heat exchanger 61 can be substituted for the exchanger 23, being connected between the lines 24 and 39. The heat exchanger 61 is of a generally conventional-type construction used to commercially convert cryogenic liquids to gases by using atmospheric air as a heat source. When the plate heat exchanger 61 is used, the water bath heater 16 can be retained, without the propane heat exchange circuit 29, to supplement the heating provided by the plate heat exchanger 61 and maintain precise temperature control.

Figure 3:
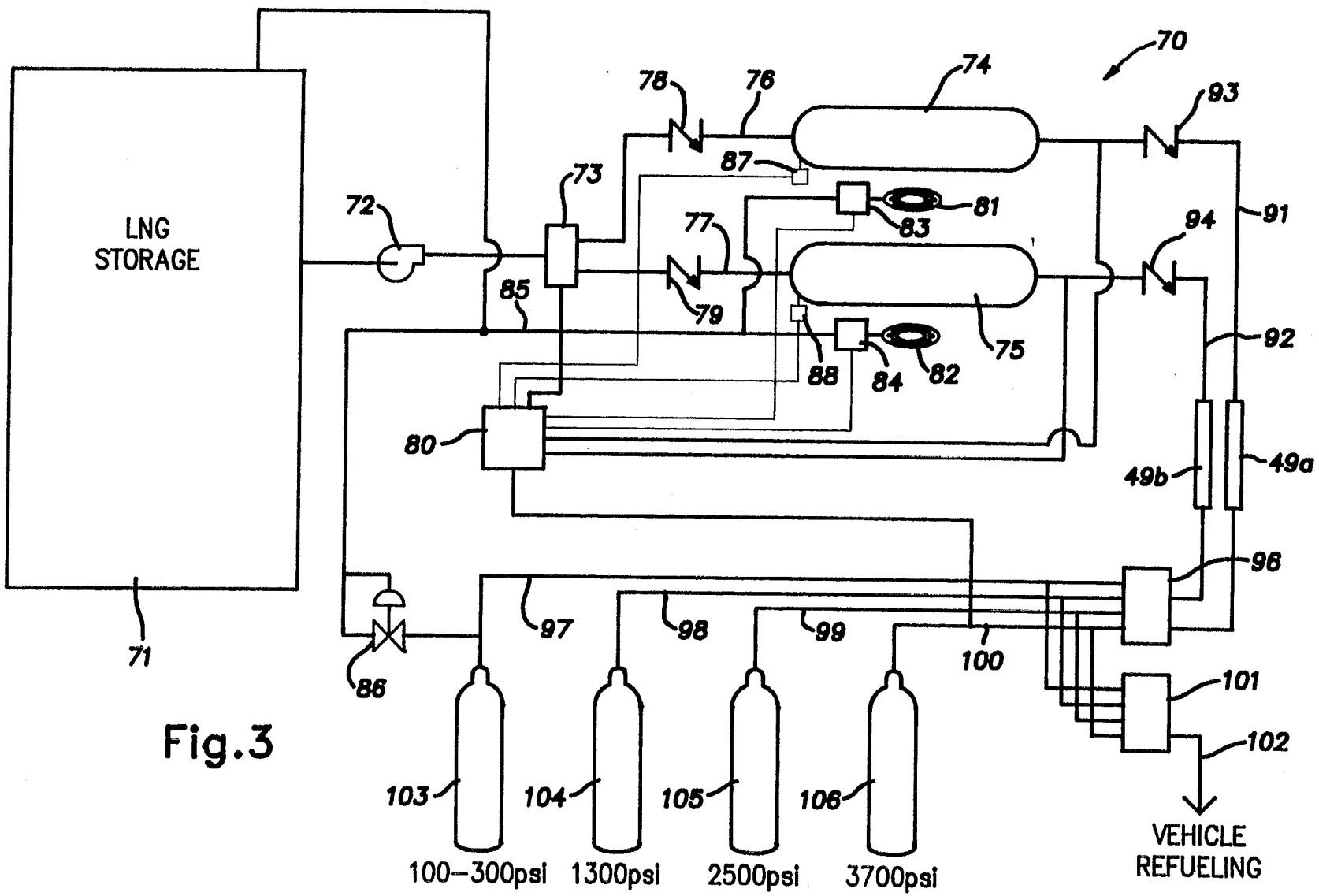
FIG. 3 is a schematic diagram of another embodiment of the present invention in which liquid natural gas is converted to its vapor state in alternate conversion vessels.

Referring now to FIG. 3, there is shown another system for converting liquid natural gas to high-pressure natural gas vapor primarily by the addition of heat energy. The system or site 70 includes a cryogenic storage tank 71 like the tank 11 of FIG. 1. A medium pressure differential transfer pump 72 moves liquid natural gas from the storage tank 71 to a control valve 73 and one of two alternate conversion tanks 74, 75. The pump 72 and associated lines carrying liquid natural gas are thermally insulated from the environment. The pressure in the storage tank 71 is in the order of 100 to 300 psi above atmosphere, for example. The circulating pump 72 is arranged to raise the pressure of the liquid natural gas to 350 psi, for example, so that this pressure is higher than that of the lowest pressure tank 103 in a cascade set of tanks described below. The pump 72 delivers liquid natural gas through the valve 73 and alternate lines 76, 77 having check valves 78, 79.

Each of the tanks 74, 75 is a closed vessel and has associated with it an individual heater 81, 82 that burns natural gas vapor boil-off from the tank 71 from a line 85 under the control of burner valves 83, 84. Any shortfall of natural gas from the boil-off to operate the burners 81, 82 can be made up from a low pressure source such as a utility or from a low-pressure tank 103 described below and fitted with a suitable pressure regulator 86 connected to the line 85.

Depending on the position of the valve 73, liquid natural gas is delivered to one or the other of the tanks 74, 75 until it is filled to the desired level, but not completely full of liquid. Sensors 87, 88 measure the weight of a respective tank 74, 75 and its contents and indicate the same to an automatic controller 80. Once filled to desired level, a tank 74 or 75 is then heated by firing its associated burner 81 or 82 through operation of the controller 80. As the tank 74 or 75 is heated, the liquid natural gas contained in it absorbs heat and is converted to high-pressure supercritical vapor in a gradual staged process coinciding with demand normally as a vehicle is being refueled. In the illustrated case, the system is arranged to produce a maximum working pressure of 3,700 psi. Natural gas at this high pressure is conducted from a tank 74 or 75 through an associated line 91 or 92 and check valves 93, 94 to a set of priority panel valves 96 of generally known construction. Heat exchangers schematically shown at **49*a*, 49*b* in the lines 91, 92 and like the heating coil 49 in FIG. 1, temper the gas to a desired temperature. The priority panel 96 has a plurality of lines 97–100 each individually connecting it to a tank of a series or cascade of tanks 103–106. The lines 97–100 are also individually connected to a set of sequence panel valves 101 also generally known in the art. The sequence panel 101 directs pressurized natural gas vapor to a vehicle to be refueled through a line 102**.

In operation, the line 102 is coupled to the fuel tank of the vehicle to be refueled. The sequence panel 101 begins the refueling process by communicating the line 102 with the lowest pressure tank 103 in the cascade. When flow from the tank 103 ceases indicating that the vehicle's fuel tank is refilled to the pressure in this tank 103, the sequence panel connects the line 102 to the next highest pressure tank 104 in the cascade. When flow ceases from that tank to the vehicle, the sequence panel shifts to the line 99 connecting the next highest pressure tank 105 to the vehicle refueling line 102. This process is repeated as the pressure in the vehicle fuel tank increases until finally the highest pressure tank 106 delivers gaseous natural gas at 3,700 psi. A valve (not shown) associated with the delivery line 102 ensures that the vehicle fuel tank is not filled to a pressure exceeding its rated working pressure of, for example, 3,600 to. 3,000 psi.

The controller 80 operates the valve 73 to feed liquid natural gas into one or the other of the conversion tanks 74, 75. Once a tank 74 or 75 is filled to a desired level with liquid, a condition sensed by a sensor of the weight of the tank and its contents and monitored by the controller 80, the controller closes the valve 73 supplying liquid natural gas to that tank and initiates operation of the associated burner 81 or 82 to raise and maintain the pressure in this tank containing liquid and vapor to 3,700 psi. A suitable pressure sensor (not shown) associated with each tank 74, 75 signals the controller 80 of the pressure existing in its associated tank. As previously mentioned, the cold low-pressure liquid natural gas is converted in the tank to high-pressure supercritical natural gas vapor at a state above the vapor dome by the addition of heat from this burner. This supercritical vapor is tempered in a heat exchanger **49*a* or 49*b* on its path to the priority panel valve 96**.

When pressure in a line 91 or 92 connecting one of the conversion tanks being depleted of vapor to the priority panel 96 drops below 3,700 psi, as a result of the tank 74 or 75 being depleted of liquid, the priority panel connects the line to the next lowest pressure tank 105 until pressure in the conversion tank drops below the nominal operating pressure of such tank. At this time, the priority panel shifts again and connects the line 91 or 92 to the next lowest tank 104 and this process repeats until pressure in the last heated conversion tank drops to the working pressure of the lowest pressure rated tank 103.

While one of the conversion tanks 74 is being heated and is discharging natural gas vapor, the other tank, under the direction of the controller 80 can be filled with liquid natural gas for conversion into natural gas vapor upon operation of the associated burner 81 or 82. Operation of this subsequent burner can be initiated by the controller 80 before the discharging tank is completely depleted of liquid so that this other tank is standing by with high-pressure vapor. This alternate tank scheduling method thus provides an uninterrupted supply of high-pressure vapor to the priority panel 96 as the pressurization cycle in the preceding tank enters the pressure reduction cascade cycle.

Suitable pressure reducing valves (not shown) can be connected from each pressure storage tank 106, 105 etc. to the next lowest pressure storage tank in the cascade to maintain pressure at their desired settings. The total volume of the cascade tanks 103–106 can be limited to less than that of the capacity of a typical fuel tank of a vehicle to be refueled at the site 70, since they are replenished from 74 or 75 continuously. Where the low pressure tank 103 operates at a pressure too low for refilling a vehicle fuel tank, its contents can be used with conventional pressure reduction, as mentioned, for fueling the burners 82, 83 or can be fed through a meter to a utility line.

Figure 4:
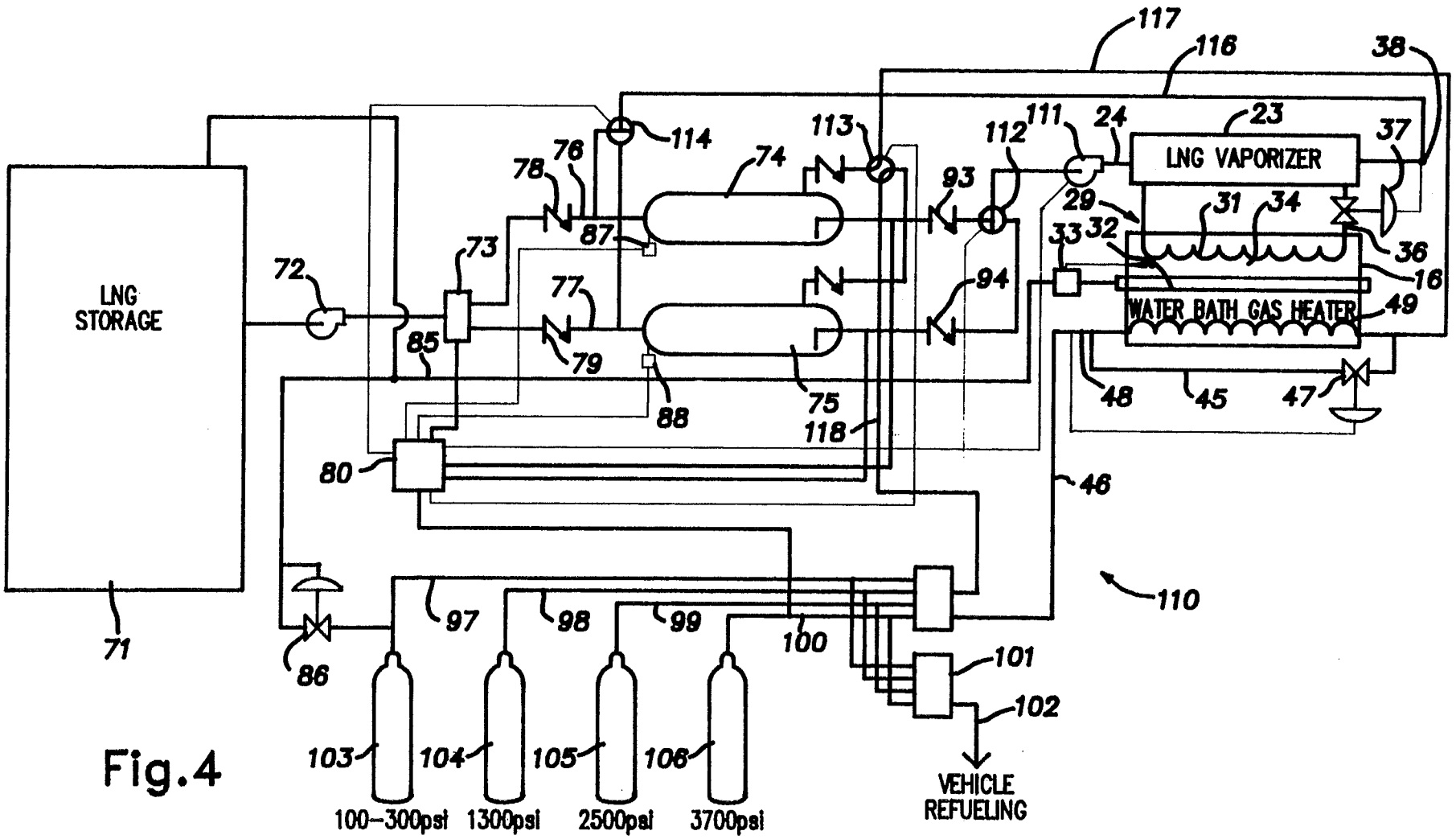
FIG. 4 is a schematic diagram of still another embodiment of the invention combining features of the systems shown in FIGS. 1 and 3.

FIG. 4 illustrates another variant of the invention wherein features of the systems 10 and 70 of FIGS. 1 and 3, respectively, are combined in a system 110. This system 110 differs from the system 70 primarily in that liquid natural gas processed in alternate tanks or vessels 74, 75 is converted to vapor at a common heat exchanger vessel 23 separate from the tanks. In the diagram of FIG. 4, components having essentially the same function as in the previously described systems 10 and 70 are identified by the same numerals.

The system 110 converts relatively low pressure liquid natural gas stored in the tank 71 to high-pressure vapor largely by the addition of thermal energy. In alternate cycles, liquid natural gas is conveyed from the processing tanks 74, 75 by a circulating pump 111, without significant mechanical pressurization, to the heat exchanger 23. In the heat exchanger 23, the liquid natural gas is changed into a vapor and is caused to increase its volume as it is converted to a vapor. This results in an increase in the pressure within the confinement defined by the components 74/74, 112-111-24-23-38-116-114 ultimately resulting in a pressure of, for example, 3,700 psi. The controller 80, operating a set of synchronized valves 112 and 114 determines which of the tanks 74, 75 is actively connected to the heat exchanger 23 while the other tank 74 or 75 is isolated from these vessels. When a tank 74 or 75 containing liquid natural gas is connected for free fluid communication to the heat exchanger 23 by the valves 112, 114 the pump 111 is operated or modulated by the controller 80 to deliver a sufficient quantity of liquid natural gas to the heat exchanger to maintain the desired working pressure in such tank. The circuitry includes a return line 116 for vapor exiting the heat exchanger 23 for delivery through the valve 114 to either one of the tanks 74 or 75. Pressure is maintained in an active one of the tanks 74 or 75 by appropriately operating the pump 111 to draw sufficient quantities of liquid natural gas from this active tank and circulate it into the heat exchanger 23. A tank 74 or 75 supplies high pressure vapor to the priority panel valve 96, the cascade tanks 103–106, and ultimately to a vehicle through the valve 113, a line 117, the water bath heater coil 49 where the cold vapor is tempered, i.e. warmed to a desired temperature, and the line 46. While one tank 74 or 75 is being depleted of liquid natural gas by vaporization in the heat exchanger 23 and delivery to the priority panel valve 96, the other tank may be refilled with a new charge of liquid natural gas by operation of the valve 73 under control of the controller 80.

When a sensor 87 or 88 indicates that a tank 74 or 75 is approaching depletion of liquid natural gas, the controller 80 switches the roles of the tanks 74 and 75. The synchronized valves 112–114 are shifted to their alternate positions. Liquid natural gas in the previously refilled tank is now circulated by the pump 111 through the heat exchanger 23 to meet the demand for high-pressure vapor. A line 118 is connected to the liquid depleted tank 74 or 75 by the 4-way valve 113 to the priority panel valve 96 through which pressure in such liquid depleted tank is reduced from 3,700 psi in the cascade ultimately to 100 to 300 psi as described above in connection with FIG. 3.

In the heat exchangers 23, 61 and in the tanks 74, 75 and associated circuitry, heating is limited by the respective controllers 33, 80 so that largely a phase change occurs in these vessels and there is no significant superheating of the vapor and the temperature at which these vessels operate is relatively constant at approximately −60° F. to −160° F., for example. In this way, thermal cycling stresses in these vessels are minimized.

Figure 5:
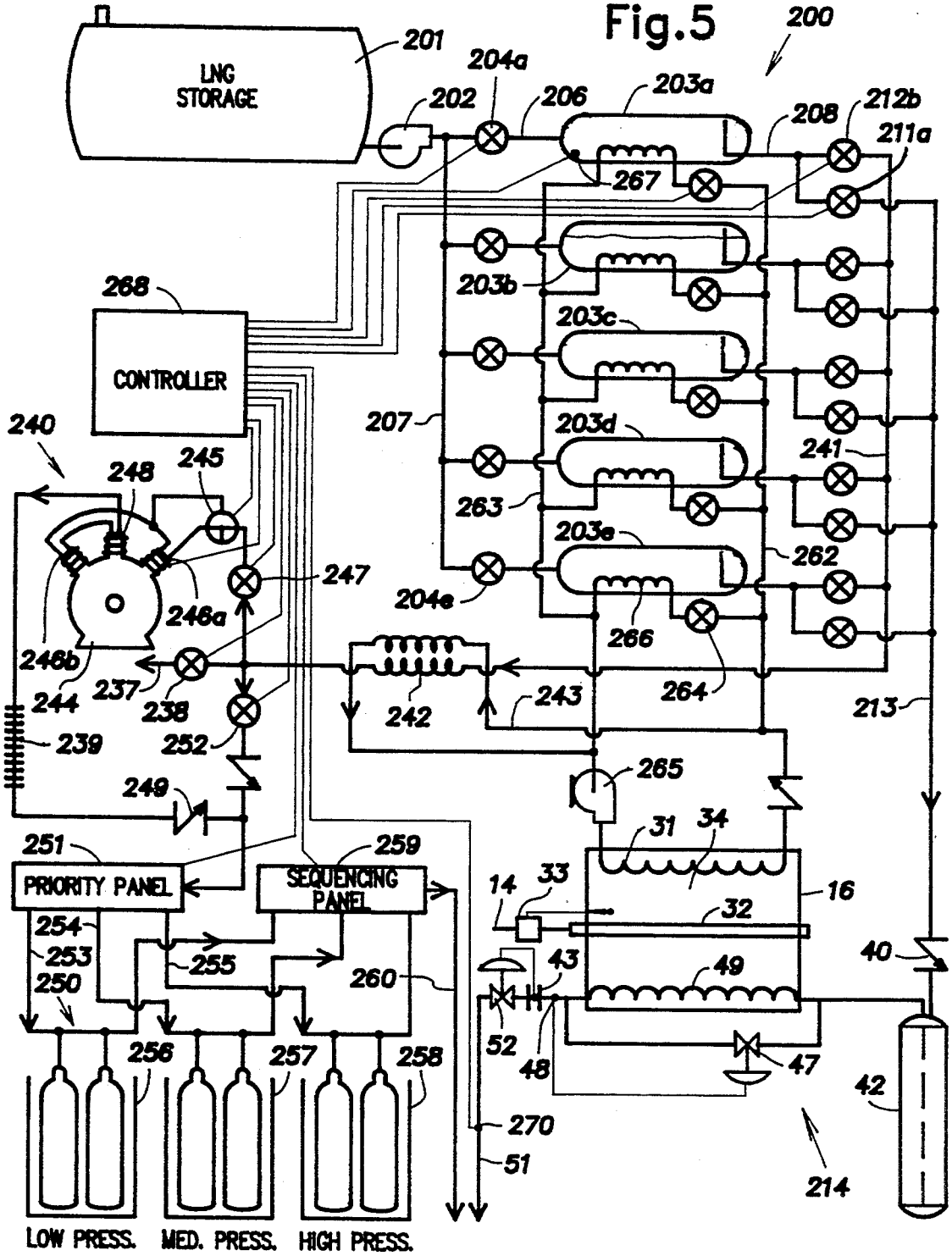
FIG. 5 is a schematic diagram of another embodiment of the invention.

Referring now to FIG. 5, there is shown another system 200 for converting LNG stored at a relatively low pressure to a high pressure gas of, for example, 4,000 psig. The system 200 includes a cryogenic storage tank 201 that is situated at the general location at which high pressure gas is made available, for example, for refueling motor vehicles that utilize high pressure compressed natural gas for fuel. The capacity of the tank 201 is sufficient, in general, to supply the needs at a particular site for preferably at least several days of fuel demand. LNG is stored in the tank 201 at, for example, a nominal pressure of 150 psig and a nominal temperature of about −240° F. to −180° F. A cryogenic LNG transfer pump 202 conveys liquid from the tank 201 to one of a plurality of pressurization/heating vessels 203, largely filling such vessel 203 with liquid. Typically, each vessel 203 is much smaller in volume than the main storage tank 201. The pump 202 is a low pressure circulating pump that increases the pressure of the LNG typically to something less than 150 psig over the pressure existing in the tank 201.

In the illustrated example, the vessels 203 are five in number and are each selectively isolated from or, alternatively, coupled to the output of the pump 202 by an associated automatically controlled low pressure LNG transfer valve 204. The vessels 203 and valves 204 (as well as other valves associated with the vessels identified below) can be essentially identical with each other. Each vessel 203 has an inlet line 206 that is connected to a common manifold line 207 from the pump 202 through its associated valve 204. Each vessel 203 has an outlet line 208 with a set of automatically controlled high pressure gas transfer valves 211 and 212. The first high pressure gas transfer valve 211 connects its respective vessel to a manifold line 213 that, in turn, is connected to a tempering and metering subsystem 214. The tempering and metering subsystem 214 delivers the main portion of the LNG processed into gas by the system 200. The tempering and metering subsystem 214 comprises elements previously described above in connection with the embodiment of FIG. 1. Elements of the subsystem 214 having the same numeral designation as those in FIG. 1 have essentially the same function. Tempered, metered gas is delivered at the line 51.

The second gas transfer valves 212 connect their respective vessels 203 to a scavenging subcircuit 240 through a manifold line 241. The manifold line 241 includes an optional tempering heat exchanger 242 that receives heat through a circuit 243. The scavenging subcircuit 240 is arranged to direct the end gas, remaining in a vessel 203 that has exhausted most of its charge through the main delivery subsystem 214 at high pressure, through one of several optional delivery paths. These optional delivery paths of the scavenging subcircuit 240 and their preferred priority schedule are discussed below.

The scavenging subcircuit 240 includes a scavenging compressor 244 that is preferably a multistage unit capable of raising the pressure of natural gas for instance from 150 psig to 4,200 psig. A first stage inlet **246*a* of the compressor is selectively connected to the manifold line 241 through an automatically controlled valve 247. A second stage inlet 246*b* of the compressor is selectively connected to the line 241 through an automatically controlled valve 245 when the pressure of the gas in the line 241 is higher than the rating of the first stage of the compressor. An outlet 248 of the compressor 244 is connected through a check valve 249 to a priority panel 251. An aftercooler heat exchanger 239 can be provided to cool the compressed gas delivered by the compressor 244**.

An automatically controlled valve 252 allows gas from the vessels 203 to bypass the compressor and be delivered to the priority panel 251 when the pressure existing in the manifold line 241 is sufficiently high. At other times, as discussed below, an automatically controlled valve 238 selectively connects the manifold line 241 from the tanks 203 to a low pressure line 237, such as a utility line, having a pressure less than 150 psig.

Gas delivered from the compressor 244, or directly through the valve 252, from the manifold line 241 enters the priority panel 251, known in the art, that selects an appropriate line 253–255 for delivery to a compressed gas storage tank cascade facility comprising tanks 256–258. Sets of the tanks 256–258 are grouped in several pressure levels, in the illustrated case, low, medium and high pressure (for example, 1,350 psi, 2,700 psi and 4,000 psi, respectively). The tanks 256–258 are used to supply either a fast fill or a slow fill demand. Discharge from the tanks 256–258 is made through a sequencing panel 259, known in the art, which connects the tank set having the next higher pressure than that existing in a tank or line representing the demand to which the sequencing panel is connected by a delivery line 260.

A heat source is provided by the heater 16. A heat conveying fluid such as propane is circulated from the heating coil 31 by a pump 265 through a manifold line 262 and returns to the heating coil through a manifold line 263. Automatically controlled pressurization control valves 264 are associated with each of the vessels 203 to selectively circulate the heat conducting fluid from the heat source 16 through a heat exchanger 266 located within or otherwise in thermal communication with the associated vessel 203. Sensors, schematically indicated at 267 monitor either or both pressure and temperature within a vessel 203. A process controller diagrammatically shown at 268 is connected by control lines to the pump 202, the sensors 267, the various described control valves, the compressor 244 as well as to other suitable sensors, control valves and/or like transducers. Additionally, sensors 270 in the delivery line 51 are connected to the controller 268 to monitor the delivery characteristics including temperature, flow rate and pressure.

The process by which the system 200 operates can be understood by reference to the conditions of the five illustrated vessels 203 at a particular moment.

A vessel **203*a* has been previously evacuated of most of the prior cycle's end gas and is at an internal pressure of less than 150 psig. The vessel 203*a* is charged and largely filled with LNG from the tank 201 by the transfer pump 202 with the associated valve 204*a* open. Gas, during charging, can be vented to the scavenging circuit 240 with the valves 212*a* and 247 open and the compressor 244 operating to deliver the gas to the compressed gas storage cascade facility 250 at whatever pressure is required at the same. The other high pressure gas transfer valve 211** is closed at this period.

A second vessel **203*b* filled preferably substantially completely with LNG is pressurized by opening of its associated pressurization control valve 264*b* whereby heat is exchanged with the LNG causing it to increase in both pressure and temperature and reach its supercritical state. The valve 264*b* is used to control internal pressure to a level needed to supply the tempering and metering system 214 through an open valve 211 and the manifold line 213. For example, the tank can be controlled at 4,000 psig where the system 214 is supplying fast fill customers at 3,600 psig. In this period the valves 204 and 212** are closed.

A vessel **203*c* depletes its LNG inventory as the fuel is heated and increased in volume at high pressure and is supplied to the system 214 via the manifold line 213. The conditions of the valves are the same as those described with reference to the vessel 203*b***.

A vessel **203*d* completely depleted of LNG, as signalled by a decrease in pressure through the associated sensor 267, is purged of the remaining end gas via the scavenging circuit 240. The heat exchanger 266*d* can be used to provide in situ tempering (i.e. tempering within the vessel 203*d*). So long as relatively high pressure is maintained in the vessel 203*d* during tempering, the scavenging compressor 244 is bypassed by opening the valve 252; when the pressure falls to a predetermined level, the valve 252 is closed, the valve 247 is opened and the scavenging compressor 244 operates to evacuate the tempered end gas. During this period the valves 204*d* and 211*d* are closed and the valves 212*d* and 264*d* are open. When this in vessel or in situ tempering is performed the optional tempering heat exchanger 242** can be eliminated.

A vessel **203*e* is purged of low temperature end gas using the scavenging compressor 244 for the entire purging operation except as low or medium pressure cascade capacity at the facility 250 is available. The purging or evacuation reduces the pressure in the vessel 203*e* ultimately to below 150 psig, for example. In this period, the valves 204*e*, 211*e* and 264*e* are closed and the valve 212*e* is open. Initially, the valve 252 is open until the cascade capacity is met without the compressor 244; thereafter, the valve 252 is closed, the valve 247 is open and the compressor 244 is operated to evacuate the tank to a level sufficiently low to next enable the transfer pump 202 to deliver a new charge of LNG into the vessel 203*e* from the storage tank 201. By avoiding in situ tempering, the vessel 203*e* is spared unnecessary temperature cycling. In this case, the optional tempering heat exchanger 242 is used to temper gas being delivered to the compressor 244 or cascade facility 250**.

The process controller 268 monitors the pressure and temperature within the vessels 203 through signal lines (shown typically with the vessel **203*a*) connected to the sensors 267. When there is a demand for high pressure fuel at the delivery line 51 signalled by a sensor 270, the controller opens and closes appropriate ones of the valves (through signal lines shown typically with the vessel 203*a*), as described, and operates the pumps 202, 265 and compressor 244 at appropriate times. In this manner, the controller 268 causes each vessel 203 to cycle through a progression of each stage described above for all of the vessels 203*a*–203*e*. The controller 268 establishes phase relationships between the cycles of vessels 203 so that as the capacity of one of the vessels is being filled with LNG, other capacity is being depleted and there is a continuity of flow of gas when a demand exists at the line 51. Where it is important that the compressor 244 be capable of operating to purge a vessel 203 when the cascade facility 250 is receiving gas directly from a different vessel or vessels 203 a third valve and manifold line like the valves 211 and 212 and lines 213, 241 can be provided to separately connect the vessels directly to the cascade facility. Typically, the volume of the individual vessels 203 is not substantially greater than the capacity of a vehicle fuel tank set or other receiver that presents an intermittent demand for fuel to the system 200 so that, in general the system will cycle as frequently or nearly as frequently as a demand is presented at the line 51 such as by a succession of vehicles and relatively small quantities of fuel are stored in gaseous form in the system between times of demand. As in the earlier described embodiments, the tempering and metering system 214 serves to raise the temperature of the gas to a control temperature at or near ambient temperature by the controlled addition of heat by measuring the temperature of the gas with the thermostatic control or sensor 48 as at least a portion of its leaves the heating coil 49 for delivery through the line 51**.

A typical strategy for operating the system 200 gives the first priority to filling the fuel tank of a vehicle with high pressure gas from a vessel 203, being heated, through the line 213, the tempering and metering system 214, and the line 51. When a vessel 203 is largely discharged and the pressure of the end gas within it begins to moderate, it is connected to the scavenging circuit 240 through the line 241. At this time the strategy of the controller 268 is to give priority to filling a vehicle tank through the line 260 without operation of the compressor 244 as long as the pressure of the end gas is higher than that existing in the vehicle tank. When the pressure of the end gas approaches or is less than that in a vehicle tank, the strategy of the controller is to direct the end gas through the priority panel into the gas storage cascade facility 250. When necessary, the compressor 244 is operated to raise the pressure of the end gas to a level sufficient to charge the lowest pressure stage of the cascade 250 with available capacity. When the cascade facility 250 is filled, the controller directs the end gas through the valve 238 to the local supply or utility line 237 in which the existing pressure is below 150 psig, for example.

In an alternative embodiment, the cascade facility 250 can be eliminated along with the valve 252 and the optional tempering heat exchanger 242. In this alternative configuration, a single scavenge circuit supply line from the manifold line 241 supplies the scavenge compressor 244 and the compressor delivers high pressure gas directly to the tempering and metering system 214. This simpler configuration gives up the savings in compressor energy provided by the cascade facility 250.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

We claim:

1. Apparatus for delivering, on a demand basis, high pressure compressed natural gas comprising a relatively large storage tank for containing a quantity of LNG at a relatively low pressure, a plurality of separate pressurizing and heating vessels, means for selectively delivering LNG to individual ones of the vessels at a relatively low pressure, means for selectively supplying heat to individual ones of the vessels, each of said vessels being arranged so that heat from said heat supplying means is absorbed by LNG contained therein in a manner wherein the LNG in the vessel is elevated to a relatively high delivery pressure of several thousand psi and heated by energy received primarily in the form of heat from said heat supplying means, means for conveying natural gas pressurized to a high level in a vessel to a delivery point, a compressor having an inlet and an outlet and being capable of raising the pressure of natural gas from a pressure level at least as low as that at which LNG is delivered to the vessel by the delivery means, to a substantially higher pressure at its outlet, and means for selectively coupling the compressor inlet to any of said vessels, in a manner free of fluid communication with the tank, in which a charge of LNG has been substantially completely pressurized.

2. Apparatus for delivering, on a demand basis, high pressure compressed natural gas comprising a relatively large storage tank for containing a quantity of LNG at a relatively low pressure, a plurality of separate pressurizing and heating vessels, means for selectively delivering LNG to individual ones of the vessels at a relatively low pressure, means for selectively supplying heat to individual ones of the vessels, each of said vessels being arranged so that heat from said heat supplying means is absorbed by LNG contained therein in a manner wherein the LNG in the vessel is elevated to a relatively high delivery pressure of several thousand psi greater than the pressure existing in the storage tank and heated by energy received primarily in the form of heat from said heat supplying means, means for conveying natural gas pressurized to a high level in a vessel to a delivery point, a compressor having an inlet and an outlet and being capable of raising the pressure of natural gas from a pressure level at least as low as that at which LNG is delivered to the vessel by the delivery means, to a substantially higher pressure at its outlet, means for selectively coupling the compressor inlet to any of said vessels in a manner free of fluid communication with the tank in which a charge of LNG has been substantially completely pressurized and a cascade subsystem in which compressed natural gas converted from LNG in said vessels is stored in a series of gas storage tanks having a preselected range of differential pressures.

3. Apparatus as set forth in claim 2, including a means for directing natural gas from the outlet of the compressor to a gas storage tank having the highest operating pressure below that of the compressor outlet.

4. Apparatus as set forth in claim 3, including valving means for selectively connecting the outlet of the vessels to a gas storage tank having the highest operating pressure below that of the connected vessel.

5. Apparatus as set forth in claim 4, including valving means to direct gas to a low pressure service line when said gas storage tanks are filled to capacity.

6. A method of supplying high pressure compressed natural gas from a storage tank of LNG maintained at relatively low pressure to satisfy an intermittent demand substantially continuously through the period of the demand comprising the steps of providing a plurality of vessels, charging one of said vessels with a volume of LNG at a pressure not substantially greater than that existing in the storage tank, while the one vessel is being charged with LNG transferring heat to a charge of LNG previously introduced into another of said vessels to cause the LNG to be pressurized and heated to a gas at a relatively high pressure, substantially higher than the pressure in the storage tank, allowing high pressure gas to express itself from a vessel other than said one vessel in which such gas has been formed from a low pressure charge of LNG introduced therein in a manner substantially the same as that used to charge said one vessel and thereafter having been subjected to heating to convert it to a high pressure gas, and purging a vessel other than said one vessel from which a charge of LNG has been converted to and expressed as a high pressure gas by coupling the inlet of a gas compressor to the vessel being purged whereby such vessel is made ready to receive a new charge of LNG from the storage tank at a pressure not substantially greater than that existing in the storage tank, the charging, pressurizing and heating and purging operations in each vessel being performed successively and cyclically.

7. A method of refueling a road transportation vehicle comprising receiving and storing liquid natural gas in a relatively large supply tank capable of holding several thousand gallons at relatively low cryogenic temperature and moderate pressure of about 30 to 100 psi, dispensing the liquid natural gas from the supply tank generally exclusively on demand when a vehicle is present for refueling, converting the dispensed gas to compressed natural gas at relatively high pressure of several thousand psi and moderate near ambient temperature through the addition of energy to the gas primarily in thermal form while simultaneously delivering the gas to a high-pressure fuel tank on the vehicle, the liquid natural gas being dispensed from the storage tank into a closed vessel and being thereafter converted to high-pressure, moderate temperature gas by the addition of heat while in or in free communication with the closed vessel and being thereafter dispensed into a fuel tank on a vehicle.

8. A method of refueling a road transportation vehicle comprising receiving and storing liquid natural gas in a relatively large supply tank capable of holding several thousand gallons at relatively low cryogenic temperature and moderate pressure of about 30 to 100 psi, dispensing the liquid natural gas from the supply tank generally exclusively on demand when a vehicle is present for refueling, converting the dispensed gas to compressed natural gas at relatively high pressure of several thousand psi and moderate near ambient temperature through the addition of energy to the gas primarily in thermal form while simultaneously delivering the gas to a high-pressure fuel tank on the vehicle, liquid natural gas being dispensed from the storage tank at relatively low pressure and temperature into alternate units of a plurality of conversion vessels, the liquid natural gas dispensed in one of said conversion vessels being heated to convert it to a high-pressure, moderate temperature gas while another of said conversion tanks is being filled with liquid natural gas from the storage tank at relatively low temperature and pressure for subsequent pressurization and heating, relatively high-pressure, moderate temperature gas being dispensed from successive ones of the conversion vessels into a vehicle fuel tank.

9. Apparatus for delivering, on a demand basis, high pressure compressed natural gas comprising a relatively large storage tank for containing a quantity of LNG at a relatively low pressure, a plurality of separate pressurizing and heating vessels, means for selectively delivering LNG to individual ones of the vessels at a relatively low pressure, means for selectively supplying heat to individual ones of the vessels, each of said vessels being arranged so that heat from said heat supplying means is absorbed by LNG contained therein in a manner wherein the LNG in the vessel is elevated to a relatively high delivery pressure of several thousand psi and heated by energy received primarily in the form of heat from said heat supplying means, means for conveying natural gas converted to a supercritical state and pressurized to a high level in a vessel to a delivery point, a compressor having an inlet and an outlet and being capable of raising the pressure of natural gas from a pressure level at least as low as that at which LNG is delivered to the vessel by the delivery means, to a substantially higher pressure at its outlet, and means for selectively coupling the compressor inlet to any of said vessels in a manner free of fluid communication with said tank in which a charge of LNG has been substantially completely pressurized.

* * * * *